US007656257B2

(12) United States Patent
McCarthy et al.

(10) Patent No.: US 7,656,257 B2
(45) Date of Patent: Feb. 2, 2010

(54) LOW ENERGY MAGNETIC ACTUATOR

(75) Inventors: Shaun David McCarthy, Dublin (IE); Michael Andrew Daly, Delgany (IE); Alan Simpson, Dublin (IE)

(73) Assignee: Steorn Limited, Dublin (IE)

( * ) Notice: Subject to any disclaimer, the term of this patent is extended or adjusted under 35 U.S.C. 154(b) by 265 days.

(21) Appl. No.: 11/235,423

(22) Filed: Sep. 26, 2005

(65) Prior Publication Data

US 2006/0066428 A1 Mar. 30, 2006

Related U.S. Application Data

(60) Provisional application No. 60/613,565, filed on Sep. 27, 2004.

(51) Int. Cl.
*H01H 9/00* (2006.01)

(52) U.S. Cl. ..... 335/207; 335/205; 335/229

(58) Field of Classification Search ..... 335/220–229; 200/5 R, 47; 310/12, 14
See application file for complete search history.

(56) References Cited

U.S. PATENT DOCUMENTS

| | | | | |
|---|---|---|---|---|
| 1,119,732 A | | 12/1914 | Tesla | |
| 3,935,487 A | * | 1/1976 | Czerniak | 310/46 |
| 4,282,501 A | * | 8/1981 | Myers | 335/258 |
| 6,239,524 B1 | | 5/2001 | Leibowitz | 310/112 |
| 6,362,718 B1 | | 3/2002 | Patrick et al. | 336/214 |
| 6,870,454 B1 | * | 3/2005 | Vladimirescu et al. | 335/220 |
| 6,900,713 B2 | * | 5/2005 | Kasashima et al. | 335/207 |
| 2003/0030342 A1 | * | 2/2003 | Chen et al. | 310/102 R |
| 2008/0260966 A1 | * | 10/2008 | Hanawa et al. | 427/569 |

FOREIGN PATENT DOCUMENTS

| | | | |
|---|---|---|---|
| EP | 0391756 | A1 | 10/1990 |
| JP | 63200035 | A | 8/1988 |
| WO | WO 9810260 | A1 | 3/1998 |
| WO | WO 0216188 | A1 | 2/2002 |
| WO | 2006071195 | A1 | 7/2006 |
| WO | WO 2006/077451 | | 7/2006 |

* cited by examiner

*Primary Examiner*—Elvin G Enad
*Assistant Examiner*—Bernard Rojas
(74) *Attorney, Agent, or Firm*—Seyfarth Shaw LLP; Brian L. Michaelis

(57) ABSTRACT

A low energy magnet actuator allows magnetic fields to be turned on and off using a small amount of energy. The magnetic actuator according to the invention generally includes a base suitable for the support of a plurality of magnets. An actuatable shield is positioned in relation to the plurality of magnets so that it effectively blocks the magnetic field when it is positioned over at least one of the magnets. The magnetic fields of the plurality of magnets interact in a manner that allows low energy actuation of the shield.

8 Claims, 5 Drawing Sheets

LOW ENERGY MAGNETIC ACTUATOR

RELATED CASE INFORMATION

This application claims benefit of U.S. Provisional Application No. 60/613,565, filed Sep. 27, 2004, which is incorporated by reference herein in its entirety.

FIELD OF THE INVENTION

The present invention relates to a magnetic actuating apparatus.

BACKGROUND OF THE INVENTION

Electromagnets are commonly used where there is a requirement for a magnetic field to be actuated (turned on/off) .

An electromagnet achieves this effect by providing (generating) a magnetic field while electrical current is applied to it. To turn off the field the current is no longer applied to the electromagnet.

The use of electromagnets to effectuate magnetic fields suffers from one major drawback—the electromagnet requires a relatively large amount of electrical energy to operate.

Many techniques are being used to reduce the amount of external energy that an electromagnet requires. Primarily these techniques relate to the efficiency of the electromagnet and its components.

SUMMARY OF THE INVENTION

A low energy magnet actuator allows magnetic fields to be turned on and off using a small amount of energy. The magnetic actuator according to the invention generally includes a base suitable for the support of a plurality of magnets. An actuatable shield is positioned in relation to the plurality of magnets so that it effectively blocks the magnetic field when it is positioned over at least one of the magnets. The magnetic fields of the plurality of magnets interact in a manner that allows low energy actuation of the shield.

In one illustrative embodiment of an actuator according to the invention, the base supports a first magnet mounted to the base in a first position. A second magnet is supported by the base in a second position relative to the first magnet. A shield is positioned relative to the first and second magnets in a configuration that enables the movement of the shield between two known positions. In this illustrative embodiment, each magnet is of similar field strength and the field that radiates from the ends are of the same polarity. The shield is of a thickness that effectively blocks the emitted magnetic field when positioned over one or the other of the magnets. The magnetic fields of the two magnets interact in a manner that allows for the low-energy movement of the shield. The exposed magnetic field may be used to perform work (e.g. interact with other magnetic fields to move an object).

Advantages of the actuator according to the invention include low energy actuation of the shield in a manner that yields motion or actuation that is highly efficient. The highly efficient actuation of the shield results in movement that can perform work in a highly efficient manner.

BRIEF DESCRIPTION OF THE DRAWINGS

The foregoing, and other features and advantages of the present invention will become more apparent from a detailed description of illustrative embodiments of the invention, taken in conjunction with the following figures, in which.

DETAILED DESCRIPTION OF THE INVENTION

The present invention is an actuator configuration that involves a plurality of magnetic fields working in conjunction to effect motion in a highly efficient manner.

Figure 1:
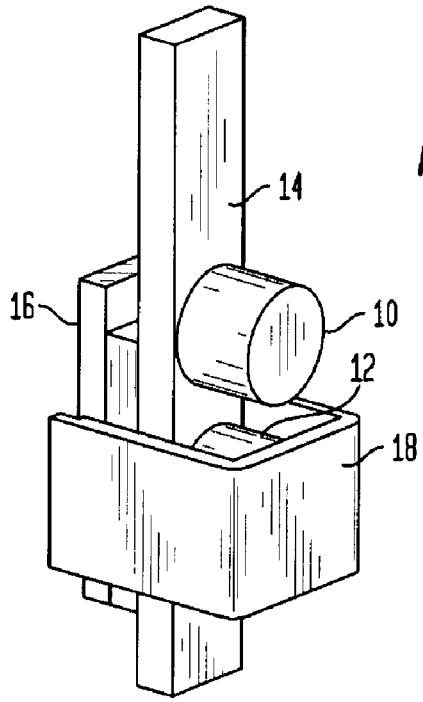
FIG. 1 shows an illustrative embodiment of an actuator according to the invention, in a first or "closed" position.
Figure 2:
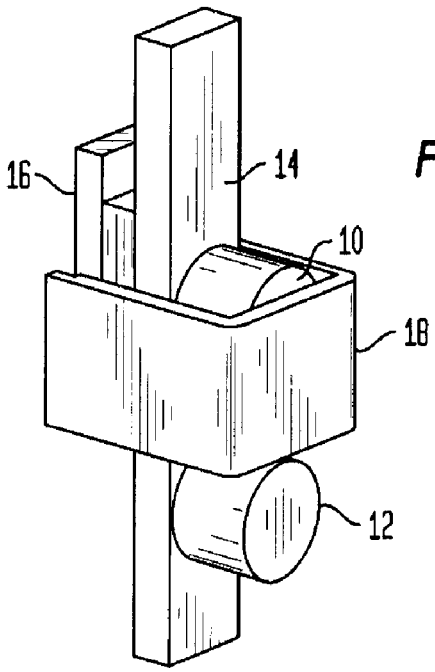
FIG. 2 shows the actuator of FIG. 1 in a second or "open" position.
Figure 3:
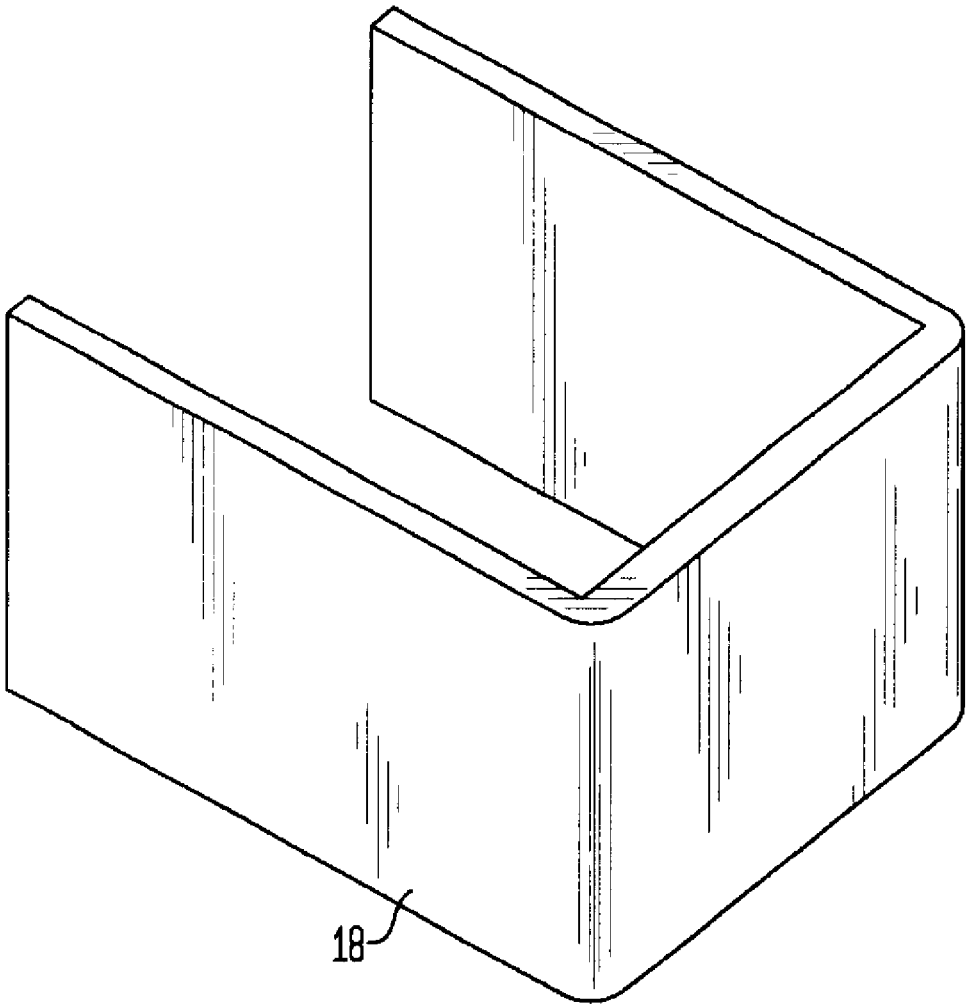
FIG. 3 is a perspective view of a shield of the embodiment of FIGS. 1 and 2.

Referring now to FIGS. 1-3, a first illustrative embodiment of an actuator according to the invention comprises a first magnet 10 and a second magnet 12 disposed on a base 14. In this embodiment the first and second magnets are fixed to the base along a longitudinal axis of the base such that the magnetic axis of each magnet is perpendicular to the longitudinal axis of the base and the magnetic axis of the first and second magnets are linearly displaced from each other along the longitudinal axis of the base. The base is disposed proximate to a linear bearing. The base 14 and linear bearing are configured to move relative to each other along the longitudinal axis of the base in this embodiment. A shield 18 is disposed in a manner to move relative to the first magnet 10 and the second magnet 12 such that shield moves in a plane that is perpendicular to the magnetic axis of the first and second magnets. The shield is driven to appropriate positions as described herein, by mechanical means (not shown), such as a linear actuator (solenoid, stepper motor, worm gear or the like), rotary actuator (cam, rotary baring or the like) or any of various other actuators.

In FIG. 1 the actuator is in a first "closed" position, i.e. with the field of the second magnet 12 effectively blocked by the shielded magnet holding the shield 18 in place. Hence, when the magnetic shield is in the 'closed' position, the magnetic field from the actuating magnet (i.e. the second magnet 12) is effectively blocked by the magnetic shield 18 (shown in detail in FIG. 3). There is little or no field just in front of the shield. Thus the second magnetic is effectively blocked and precluded from doing any work.

As illustrated in FIG. 2, when the actuator is in the 'open' position (i.e. the second magnet is not shielded) the magnetic field for the actuating magnet (i.e. the second magnet) operates as normal i.e., the magnetic field is not blocked. Hence this field is now 'active' in the position where it was previously blocked by the shield 18 (FIG. 3), and the first magnet is blocked.

In this manner the field from the second or actuating magnet (1) is effectively turned on and off. It should be appreciated that either of the first or second magnet can be used and designated as the "actuating" magnet.

As illustrated in FIGS. 1 and 2, the first magnet 10 acts as a "balancing magnet" and allows the movement of the shield 18 to happen for a relatively low amount of energy. Without this balancing magnet 10 the force to move the shield 18 down is relatively high and the system is highly inefficient. The balancing magnet 10 substantially reduces the energy required to move the shield 18 over the actuating magnetic field.

The positioning of the magnetic shield 18 relative to the balancing and actuating magnets allows for minimal energy to effect actuation. In the open position (FIG. 2) the bottom edge of the magnetic shield should be close to the top edge of the balancing magnet 10. In the closed position (FIG. 1) the top edge of the shield should be close to the bottom of the actuating magnet 12. Mechanical stops may be used to optimally position the shield or otherwise limit the movement thereof.

FIG. 1 shows a first illustrative embodiment of a magnetic actuator according to the invention, comprising the first magnet 10 fixed to the base 14 which is made of aluminum. The second magnet 12 in this embodiment is of substantially equal strength as the first magnet 10 and is fixed to the base in relative position to the first magnet 10. In this embodiment the second magnet 12 is the actuating magnet in that when it is "open" (i.e. not shielded), it is used to perform work such as by interaction with other entities (for example, other proximate magnetic fields). The first magnet 10 is the balancing magnet in that its primary function is to interact with the shield 18 providing the blocking method for the magnetic fields.

The shield 18 in this embodiment is positioned in particular relation to both magnets, and is made of a magnetic shield material, such as NETIC S3.6 available from Magnetic Shield Corporation of Bensenville, Ill. In this illustrative embodiment the bottom edge of the first magnet 10 is approximately 15 mm from the top edge of the second magnet with the magnets being approximately 25 mm in diameter. In this embodiment the shield is approximately 30 mm in width and 50 mm in height. In this embodiment the shield is configured such that an inner surface of the shield is approximately 5 mm from a top (flat) surface of the magnets). These dimensions are illustrative and are a function of the size of the actuator and shield.

Figure 4:
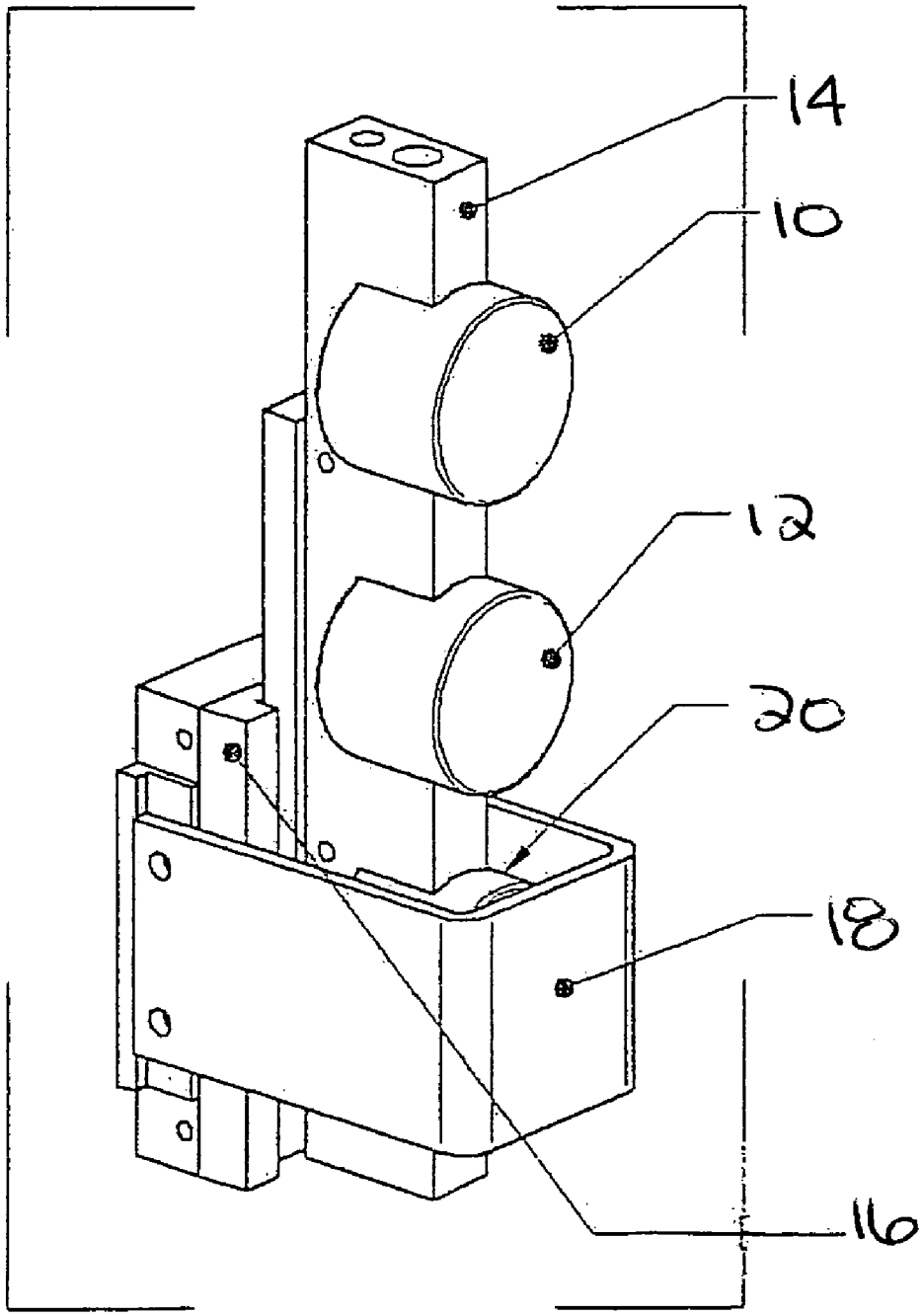
FIG. 4 shows an alternative embodiment of the invention utilizing three magnets in the actuator.

It should be appreciated that more than a first and second magnet may be implemented in an actuator according to the invention. FIG. 4 shows an additional embodiment of the invention utilizing three magnets in the actuator. In this instance a third magnet 20 is substantially identical to the other two magnets in terms of size, strength and configuration. The third magnet 20 is disposed on the base 14 in such a fashion that the shield can move in front of it on a linear bearing as per the previous embodiment.

Figure 5:
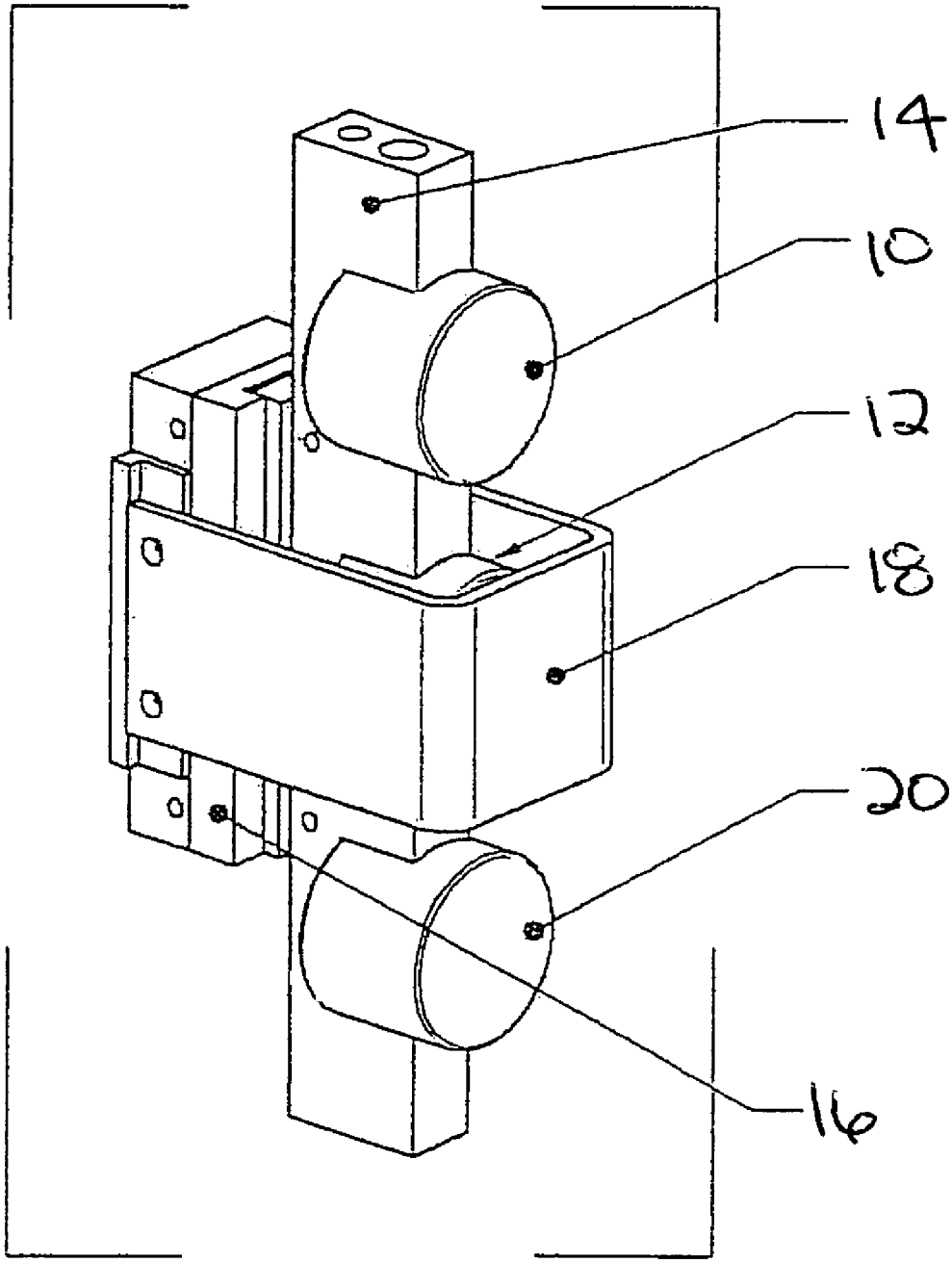
FIG. 5 shows the three magnet actuator of FIG. 4 with the shield in a first "closed" position.

FIG. 5 shows the three magnet configuration of FIG. 4 with the shield 18 now having reached the closed position in front of the second magnet 12. The movement of the shield 18 along the linear bearing 16 from the third magnet 20 towards the second magnet 12 allows the magnetic field from the third magnet 20 (the actuating magnet) to operate as a function of its magnetic field being exposed.

Figure 6:
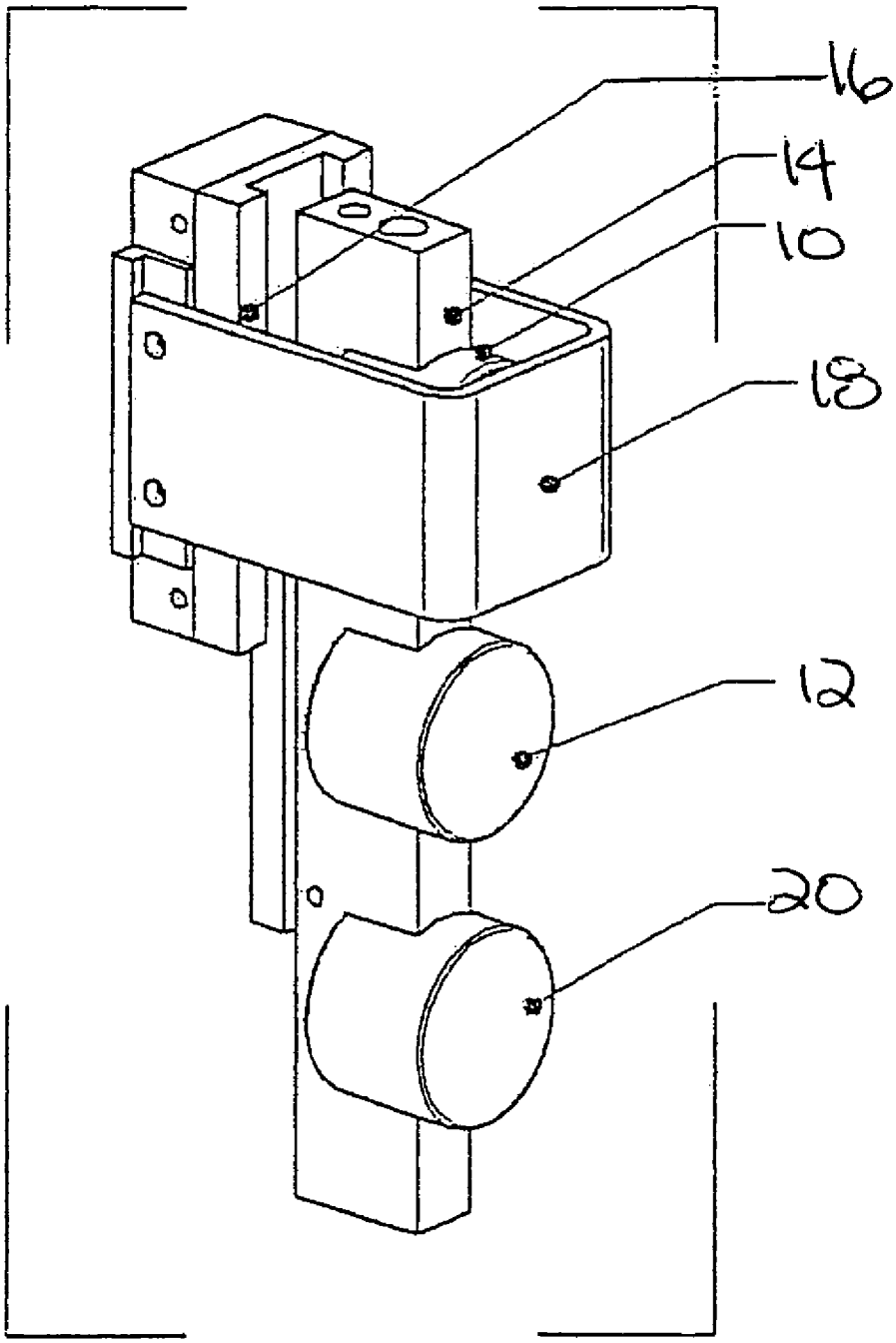
FIG. 6 shows the three magnet actuator of FIG. 4 with the shield in a second "closed" position.

Similarly, FIG. 6 shows the three magnet configuration of the actuator with the shield 18 having reached the closed position in front of the first magnet 10. The movement of the shield 18 along the linear bearing 16 from the second magnet 12 towards the first magnet 10 allows the magnetic field from the second magnet 12 (which now becomes the actuating magnet) to operate as a function of its magnetic field being exposed. It should be appreciated that in the three magnet embodiment that two of the magnets may be used as actuating magnets.

The present invention is not restricted to the above embodiments. In relation to the magnets and shield, all magnets on the base are fixed to the base, such as by an adhesive, and arranged such that their end portions are of the same polarity and the magnetic field radiates outward from the base. However, it is possible that the polarities of the outward end portions of the permanent magnets are alternately changed. The magnets may have different magnitudes of magnetic force. In addition the shield may be of varying dimensions and geometric configuration.

The system works by moving the magnetic shield in front of one of the permanent magnets or any of various other means of generating a magnetic field. Actuation of the shield in the foregoing embodiments is effected on a low friction linear bearing. The drive mechanism (not shown) for the shield is provided by an external force such as a solenoid, linear motor or the like. The addition of the balancing magnet allows actuation operation to be done for relatively low amounts of energy. While a balancing magnet, or magnets are currently viewed to be the best method of achieving low energy actuation, it should be appreciated that various other methods can produce the same or similar results. Use of springs, pneumatics or the like can also provide the balancing force. Furthermore, it should be appreciated that an actuator according to the invention can be implemented in a wide range of scales, from a miniature scale such as would be implemented in a micromechanical or micro electro mechanical structure to a large scale actuator such as implemented with large permanent magnets and other mechanical structures.

It should be appreciate that in the foregoing description that the use of the terms "open" and "closed" are nominal and are used for illustration purposes only, as are the terms "top" and "bottom."

Although the invention is shown and described hereinbefore with respect to illustrative embodiments thereof, persons having ordinary skill in the art should appreciated that the foregoing and various other changes, omissions and additions in the form and detail thereof may be made without departing from the spirit and scope of the invention.

What is claimed is:

1. A magnetic actuator, comprising:

a base;

a first magnet disposed on the base in a first position and having a first magnetic axis oriented perpendicularly to the base;

a second magnet disposed on the base in a second position relative to the first magnet and having a second magnetic axis oriented perpendicularly to the base; and a shield that is movable along said base in a plane that is perpendicular to said first magnetic axis and said second magnetic axis, and configured for actuation between a first position and a second position, when the shield is in the first position it substantially blocks a magnetic field emanating from the first magnet and leaves a magnetic field emanating from the second magnet substantially exposed, and when the shield is in the second position it substantially blocks a magnetic field emanating from the second magnet and leaves a magnetic field emanating from the first magnet substantially exposed.

2. The magnetic actuator of claim 1 characterized in that each of the first magnet and second magnet is of similar field strength.

3. The magnetic actuator of claim 1 characterized in that the field that radiates from the ends of the first magnet and the second magnets is of the same polarity.

4. The magnetic actuator of claim 1 characterized in that the shield is of a thickness that effectively blocks the emitted magnetic field when positioned over one of the first magnet and the second magnet.

5. The magnetic actuator of claim 1 fun her comprising a linear bearing and the shield is disposed on the linear bearing and moves relative to the base.

6. The magnetic actuator of claim 1 wherein the first magnet is fixed to the base.

7. The magnetic actuator of claim 1 wherein the second magnet is fixed to the base.

8. The magnetic actuator of claim 1 further comprising a third magnet disposed on the base.

* * * * *